US008394209B2

(12) United States Patent
Izumi et al.

(10) Patent No.: US 8,394,209 B2
(45) Date of Patent: Mar. 12, 2013

(54) HIGH-STRENGTH STEEL SHEET EXCELLENT IN RESISTANCE TO STRESS-RELIEF ANNEALING AND IN LOW-TEMPERATURE JOINT TOUGHNESS

(75) Inventors: Manabu Izumi, Kakogawa (JP); Makoto Kariyazaki, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 477 days.

(21) Appl. No.: 12/359,517

(22) Filed: Jan. 26, 2009

(65) Prior Publication Data

US 2009/0246067 A1 Oct. 1, 2009

(30) Foreign Application Priority Data

Mar. 28, 2008 (JP) ..... 2008-088136

(51) Int. Cl.
*C22C 38/00* (2006.01)

(52) U.S. Cl. ..... 148/333; 148/320; 148/328; 148/334; 148/335; 148/579; 420/104; 420/105; 420/109; 420/112; 420/115

(58) Field of Classification Search ..... 148/320, 148/328, 333, 334, 335, 579; 420/104, 109, 420/105, 112, 115
See application file for complete search history.

(56) References Cited

U.S. PATENT DOCUMENTS

| | | | | |
|---|---|---|---|---|
| 4,008,103 | A * | 2/1977 | Miyoshi et al. | 148/653 |
| 6,953,508 | B2 * | 10/2005 | Ikeda et al. | 148/320 |

FOREIGN PATENT DOCUMENTS

| | | |
|---|---|---|
| EP | 0 320 003 | 6/1989 |
| EP | 1 662 014 A1 | 5/2006 |
| JP | 57-116756 | 7/1982 |
| JP | 57-120652 | 7/1982 |
| JP | 1-275719 | 11/1989 |
| JP | 8-283904 | 10/1996 |
| JP | 09-287027 | 11/1997 |
| JP | 10-88277 | 4/1998 |
| JP | 10-195596 | 7/1998 |
| JP | 11-131177 | 5/1999 |
| JP | 11-310846 | 11/1999 |
| JP | 2000-336453 | 12/2000 |
| JP | 2001-89825 | 4/2001 |
| JP | 2002-3983 | 1/2002 |
| JP | 2002-003983 A * | 1/2002 |
| WO | WO 02/48417 A1 | 6/2002 |

OTHER PUBLICATIONS

Office Action issued Mar. 21, 2011, in Korean Patent Application No. 2009-00255781, filed Mar. 26, 2009 (with English Language Translation).

* cited by examiner

*Primary Examiner* — Sikyin Ip
(74) *Attorney, Agent, or Firm* — Oblon, Spivak, McClelland, Maier & Neustadt, L.L.P.

(57) ABSTRACT

A high-strength steel sheet according to the present invention not only is suitably adjusted in its chemical elements composition, but also has a DE value defined by the following Equation (1) of 0.0340% or more, and a carbon equivalent Ceq defined by the following Equation (2) of 0.45% or less:

$$DE\ \text{value}=[Ti]+[Nb]+0.3[V]+0.0075[Cr] \quad (1)$$

where, [Ti], [Nb], [V], and [Cr] represent contents (mass %) of Ti, Nb, V, and Cr, respectively;

$$Ceq=[C]+[Mn]/6+([Cr]+[Mo]+[V])/5+([Cu]+[Ni])/15 \quad (2)$$

where, [C], [Mn], [Cr], [Mo], [V], [Cu], and [Ni] represent contents (mass %) of C, Mn, Cr, Mo, V, Cu, and Ni, respectively. A high-strength steel sheet resistant to strength reduction and good in low-temperature toughness of HAZ even when subjected for a long time to a stress-relief annealing process after being processed by welding, is provided.

16 Claims, 1 Drawing Sheet

HIGH-STRENGTH STEEL SHEET EXCELLENT IN RESISTANCE TO STRESS-RELIEF ANNEALING AND IN LOW-TEMPERATURE JOINT TOUGHNESS

BACKGROUND OF THE INVENTION

1. Field of the Invention

The present invention relates to a high-strength steel sheet resistant to strength reduction and excellent in low-temperature toughness of a weld heat affected zone (hereinafter, sometimes referred to as "HAZ"), even when subjected for a long time to a stress-relief annealing process (hereinafter, sometimes referred to as "SR process") after being processed by welding.

2. Description of the Related Art

Makers of large steel pressure vessels (tanks) are promoting on-site assembly of overseas tanks for cost reduction in recent years. It has been usual to complete a tank by carrying out processes including a cutting process for cutting out steel workpieces, a shaping process for bending the steel workpieces, an assembling process for assembling the steel workpieces by welding, an SR process (local heat treatment) for processing some of the steel workpieces, and a final assembling process at the maker's plant and to transport the completed tank to an installation site.

There is a trend, in view of improving efficiency, toward building a tank by carrying out processes for cutting out workpieces, bending the workpieces to produce component members in the maker's plant, transporting the component members, building a tank on site by assembling the component members by welding and processing the entire tank by an on-site SR process.

As the method of building a tank thus changes, time for which the SR process is continued and the number of cycles of the SR process need to be increased from the view point of on-site welding techniques and safety. A fact that the component members of a tank are subjected to an SR process for a time between about 10 to 30 hours in total needs to be taken into consideration in designing materials. It is known that carbide grains contained in a steel agglomerate in large carbide grains remarkably reducing the strength of the steel when the steel is subjected to an SR process for such a long time.

A rolling process combining a controlled rolling process and a controlled cooling process is referred to as TMCP (Thermo-Mechanical Control Process) and is widely used as a process for obtaining a steel having high-strength, high-toughness, and high-weldability while having a low carbon equivalent (hereinafter, the steel is referred to as a "TMCP steel"). The TMCP steels are widely used in growing fields from the steel sheets for welded structures centering on shipbuilding to the steel sheets for pressure vessels such as tanks. Even when a pressure vessel is structured by using such TMCP steel, there is a possibility that the strength of the steel sheet could be remarkably decreased when subjected to an SR process treatment for such a long time.

In order to deal with such situations, the steel sheet is generally made to have high-strength before an SR process; however, in order to maintain high-strength under a severe SR process condition, the steel sheet needs to contain a large amount of an alloy element, which causes a problem that the HAZ toughness (in particular, low-temperature toughness) of welded structures is deteriorated.

As a technique for minimizing strength reduction due to an SR process to the least possible extent, a "tough and hard steel for pressure vessels" containing basically Cr at 0.26 to 0.75% and Mo at 0.45 to 0.60% is presented in, for example, Japanese Patent Application Laid-Open No. S57-116756. In this technique, Cr is added to the steel to suppress the coarsening of carbide grains due to an SR process and to suppress strength reduction due to an SR process. However, the problem that the low-temperature toughness of HAZ is deteriorated because of a large Cr content, remains unsolved in such a steel material.

A "high-strength and tough steel for pressure vessels" containing basically Cr at 0.10 to 1.00% and Mo at 0.45 to 0.60%, is presented in Japanese Patent Application Laid-Open No. S57-120652. The technique intends to suppress the coarsening of $Fe_3C$ grains into large $M_{23}C_6$ grains due to processing by a long SR process by adding Cr. In the technique, it is assumed that Cr is contained in a relatively wide range of content; however, only high-strength steels having a Cr content of 0.29% or more are disclosed, and hence it is expected that those high-strength steels are unsatisfactory in the low-temperature toughness of HAZ.

SUMMARY OF THE INVENTION

The present invention has been made in view of the above situations and an object of the invention is to provide a high-strength steel sheet resistant to strength reduction (that is, excellent in resistance to stress-relief annealing process) even when subjected for a long time to stress-relief annealing process after being processed by welding and excellent in low-temperature toughness of HAZ (hereinafter in the present invention, the property is referred to as "low-temperature joint toughness").

A high-strength steel sheet according to a primary aspect of the present invention that has solved the above problem contains: C at 0.10 to 0.16% (herein, the term "%" means "mass %", the same is true hereinbelow), Si at 0.05 to 0.50%, Mn at 1.3 to 1.9%, Al at 0.01 to 0.05%, Ti at 0.005 to 0.025%, Nb at 0.005 to 0.025%, V at 0.005 to 0.06%, Cr at 0.05 to 0.25%, and N at 0.0030 to 0.01%, respectively, with a balance consisting of iron and inevitable impurities, wherein: a DE value defined by the following Equation (1) is 0.0340% or more; a carbon equivalent Ceq defined by the following Equation (2) is 0.45% or less; and the steel sheet is produced under the condition that a rolling reduction rate in a non-recrystalline region is 10% or more:

$$DE\ \text{value}=[\text{Ti}]+[\text{Nb}]+0.3[\text{V}]+0.0075\ [\text{Cr}] \quad (1)$$

where, [Ti], [Nb], [V], and [Cr] represent contents (mass %) of Ti, Nb, V, and Cr, respectively;

$$Ceq=[\text{C}]+[\text{Mn}]/6+([\text{Cr}]+[\text{Mo}]+[\text{V}])/5+([\text{Cu}]+[\text{Ni}])/15 \quad (2)$$

where, [C], [Mn], [Cr], [Mo], [V], [Cu], and [Ni] represent contents (mass %) of C, Mn, Cr, Mo, V, Cu, and Ni, respectively.

In the high-strength steel sheet according to this aspect, it is also useful to further contain Cu at 0.04 to 0.50%, Ni at 0.04 to 0.50%, and Ca at 0.0005 to 0.0040% or the like in addition to the above basic elements, if needed; and the property of the steel sheet can be further improved in accordance with the types of the elements contained.

According to the aspect of the present invention, the following advantages can be obtained by controlling a composition of chemical elements in a steel sheet such that a DE value represented by the above Equation (1) and a carbon equivalent Ceq represented by the above Equation (2) satisfy specified ranges, respectively: a dislocation density ρ of the steel sheet can be maintained at a certain value or more after an SR process; strength reduction can be suppressed after the SR process; and the steel sheet can be made to be excellent in the low-temperature joint toughness. Such a high-strength steel sheet is extremely useful as a material for tanks (pressure vessels) or the like subjected to a severe SR process.

DETAILED DESCRIPTION OF THE PREFERRED EMBODIMENT

Figure 1:
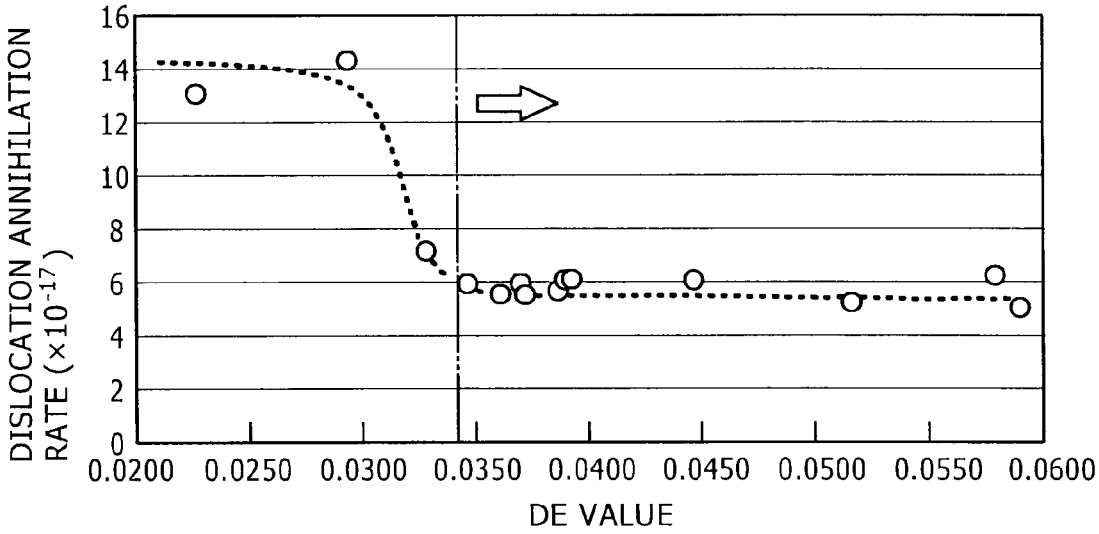
FIG. 1 is a graph showing the relation between the DE value and The dislocation annihilation rate k.

The present inventors have made studies on steel sheets from various aspects, aiming to attain a steel sheet that is resistant to strength reduction even when subjected for along time to an SR process and excellent in the low-temperature toughness. As a result, the inventors have found that, in a steel sheet of which chemical elements composition is strictly controlled, a dislocation density ρ thereof can be maintained at a certain value or more ($2.5\times10^{14}/m^2$ or more) after being subjected for a long time to an SR process, thereby the above aim is successfully attained; and they have completed the present invention. Hereinafter, the constitution, and the operation/effect of the present invention will be described along the history in which the invention has been completed.

The present inventors have considered that strength reduction in a steel sheet due to an SR process is caused by a loss of transformation toughening entailed by a decrease in the dislocation density ρ. The "transformation toughening" is a strengthening mechanism of which basic principle is that "dislocation is pinned by a direct interaction between dislocations present on different slip planes". That is, a higher dislocation density causes a larger obstacle mutually, allowing the steel sheet to be strengthened.

A steel has higher strength as the dislocation density ρ remains in larger amounts after being subjected to an SR process. In a steel subjected to a normal reheating, quenching and tempering process (hereinafter, referred to as a "QT (Quench-Temper) steel), almost dislocations are annihilated by a quenching process prior to an SR process; and in a conventional TMCP steel, almost dislocations are annihilated by being subjected to a severe SR process even when the steel has a high dislocation density before being subjected to the SR process.

Then, the present inventors have assumed that it is needed that dislocations in a TMCP steel are made not to be annihilated to the least possible extent in order to use the dislocations for securing the strength of the steel after being subjected to an SR process. Based on the assumption, the inventors have further developed the study on the effects of the dislocation density and chemical elements on the strength after being subjected to an SR process.

As a result, it has been found that the dislocation annihilation of a steel during a high-temperature and long-hour SR process can be controlled by precipitations, even if the steel has reduced alloy elements in which the low-temperature joint toughness is secured; and by adopting the above constitution, a high-strength steel has been attained in which not only strength is secured satisfactory, but also the low-temperature joint toughness is not deteriorated after being subjected to an SR process.

An SR process is carried out at a high temperature of 586 to 625° C. for 20 to 30 hours, and under such severe conditions, many precipitations are incorporated into solid solution. However, it can be assumed from the comprehensive thermodynamics software("Themo-Calc" purchasable from CRC Research Institute)that Ti, Nb, V, and Cr form stable precipitations such as compositions, for example, TiC, NbC, VC, and $Cr_2C$.

Then, the present inventors have calculated an amount of precipitations in an equilibrium state in terms of temperature based on the above Themo-Calc, followed by further correction such that the amount meets a non-equilibrium state; as a result, it has been found that an amount of elements that remain as precipitations and are effective for suppressing the dislocation annihilation, is an amount that a DE value defined by the following Equation (1) is 0.0340% or more. More preferably, a DE value is 0.0370% or more. However, any element contained in too much amount impairs weldability; hence, there is naturally a higher limit of any element (described later).

$$DE\ \text{value}=[\text{Ti}]+[\text{Nb}]+0.3[\text{V}]+0.0075[\text{Cr}] \quad (1)$$

where, [Ti], [Nb], [V], and [Cr] represent contents (mass %) of Ti, Nb, V, and Cr, respectively.

A steel sheet of the present invention is also required to have a carbon equivalent Ceq defined by the following Equation (2) of 0.45% or less, in order to keep the low-temperature joint toughness good. The carbon equivalent Ceq is obtained by converting each element's influence exerted on the low-temperature joint toughness to a carbon amount, and is used in various fields (ASTM Standards). In the present invention, such carbon equivalent Ceq is used as the criteria for judging low temperature joint toughness. It is noted that the following Equation (2) includes Cu and Ni as terms, which are contained if needed, in addition to the basic elements (C, Mn, Cr, and V) of the steel sheet according to the present invention; however, a Ceq may be calculated, taking into consideration of the contents of Cu and Ni only when the two are contained (with respect to Mo, the description will be made later):

$$Ceq=[\text{C}]+[\text{Mn}]/6+([\text{Cr}]+[\text{Mo}]+[\text{V}])/5+([\text{Cu}]+[\text{Ni}])/15 \quad (2)$$

where, [C], [Mn], [Cr], [Mo], [V], [Cu], and [Ni] represent contents (mass %) of C, Mn, Cr, Mo, V, Cu, and Ni, respectively.

In a steel sheet of the present invention, the resistance to SR process after being subjected to a severe SR process and the low-temperature joint toughness thereof can be made excellent, by making a DE value defined by the above Equation (1) be 0.0340% or more and a carbon equivalent Ceq defined by the above Equation (2) be 0.45% or less. The "severe SR process" should refer to not only the time for which the process is being carried out, but also the relation with the temperature at which the process is being carried out. In the present invention, a condition with a P value, which is defined by the following Equation (3), of 18.8 or more is considered to be the criteria for judging a severe SR process objectively. That is, the steel sheet of the present invention has the good resistance to SR process and the good low-temperature joint toughness even when being subjected to an SR process under the condition with a P value defined by the following Equation (3) of 18.8 or more:

$$\text{P value}=T(20+\log t_0) \quad (3)$$

where, T represents a heating temperature in an SR process (K), and $t_0$ represents a heating time in the SR process (hour).

In a high-strength steel sheet of the present invention, basic elements such as C, Si, Mn, Al, Ti, Nb, V, Cr, and N are required to be adjusted to be within suitable ranges. The reasons for setting the ranges for these elements are as follows:

[C: 0.10 to 0.16%]

C is an important element for improving the quenching property of a steel sheet and for securing certain strength after being subjected to an SR process; however, when contained in too much amounts, C impairs the weldability, hence, C should be contained in an amount of 0.16% or less. From a viewpoint of securing the weldability, a less C content is more preferable; however, when the content is below 0.10%, strength cannot be secured after being subjected to an SR process because the quenching property is deteriorated. The preferable lower limit of C content is 0.11%, and the preferable higher limit thereof is 0.13%.

[Si: 0.05 to 0.50%]

Si acts as a deoxidation agent in melting a steel, and has an effect of increasing strength thereof. Si should be contained in an amount of 0.05% or more in order to demonstrate such effect effectively. However, when contained in too much amounts, the weldability is deteriorated; hence, Si should be contained in an amount of 0.50% or less. The preferable lower limit of Si content is 0.20%, and the preferable higher limit thereof is 0.40%.

[Mn: 1.3 to 1.9%]

Mn is an element having an effect of increasing strength of a steel sheet. Mn should be contained in an amount of 1.3% or more in order to demonstrate such effect effectively. However, when contained in too much amounts, Mn impairs the weldability; hence, Mn should be contained in an amount of 1.9% or less. The preferable lower limit of Mn content is 1.40%, and the preferable higher limit thereof is 1.6%.

[Al: 0.01 to 0.05%]

Al is added as a deoxidation agent; however, when contained in an amount of 0.01% or less, the effect is not demonstrated sufficiently, and when contained in too much amounts exceeding 0.05%, it impairs the cleanness of a steel sheet; hence, Al should be contained in an amount of 0.05% or less. The preferable lower limit of Al content is 0.015%, and the preferable higher limit thereof is 0.03%.

[Ti: 0.005 to 0.025%]

As stated above, Ti demonstrates an effect of suppressing dislocation annihilation by forming precipitations; therefore, it is an effective element for securing the strength of a steel sheet after being subjected to an SR process. Ti is required to be contained in an amount of 0.005% or more in order to demonstrate such effect. However, when contained in too much amounts, Ti impairs the weldability of the steel sheet; hence, Ti should be contained in an amount of 0.025%. The preferable higher limit of Ti content is 0.020%.

[Nb: 0.005 to 0.025%]

Nb is not only effective for improving the quenching property and for further strengthening the dislocation introduction effect (described later) by a non-recrystallization rolling, but also demonstrates an effect that, in a steel sheet of the present invention, V and Cr are made to remain as respective carbides in the sheet by combined addition of V and Cr with Nb, when the sheet is being subjected to an SR process, contributing to suppression of the dislocation annihilation. Nb should be contained in an amount of 0.005% or more in order to demonstrate such effect. However, when contained in too much amounts, Nb impairs the weldability of the steel sheet; hence, Nb should be contained in amount of 0.025% or less. The preferable lower limit of Nb content is 0.010%.

[V: 0.005 to 0.06%, Cr: 0.05 to 0.25%]

V and Cr originally have high solid solubility with cementite, but the solid solubility thereof is reduced by combined addition with Nb, causing the formation of VC and $Cr_2C$. The precipitations remain stably even when being subjected to an SR process. V should be contained in an amount of 0.005% or more and Cr is in an amount of 0.05% or more, in order to demonstrate such effect. However, when contained in too much amounts, these elements impair the weldability; hence, V should be contained in an amount of 0.06% or less, and Cr in an amount of 0.25% or less. The preferable lower limit of V content is 0.020%, and the preferable higher limit there of is 0.040%; and the preferable lower limit of Cr content is 0.10%.

[N: 0.0030 to 0.01%]

N forms precipitations in a weld heat affected zone (HAZ) of a welded joint along with Ti, and is an effective element for suppressing the coarsening of the structure by pinning. N should be contained in an amount of 0.0030% or more in order to demonstrate such effect. However, when contained in too much amounts exceeding 0.01%, N impairs the weldability.

Basic elements in a high-strength steel sheet of the present invention are as stated above, and the balance thereof consists of iron and inevitable impurities. Examples of the inevitable impurities include P, S, and O or the like that are possibly mixed therein as steel materials or in the production process. Among these impurities, both P and S decrease the weldability and the toughness after being subjected to an SR process; hence, P is preferably contained in an amount of 0.020% or less, and S in an amount of 0.01% or less. A steel sheet of the present invention does not include Mo actively; however, when Mo is contained up to 0.02%, Mo is handled as an inevitable impurity.

It is also useful that (a) Cu: 0.04 to 0.50% and/or Ni: 0.04 to 0.50% (b) Ca: 0.0005 to 0.0040% or the like are contained in a steel sheet of the present invention, if needed. Properties of the steel sheet can be further improved according to the types of the elements contained. The ranges within which these elements are contained are set based on the following reasons.

[Cu: 0.04 to 0.50% and/or Ni: 0.04 to 0.50%]

These elements are effective for improving the strength of a steel sheet after being subjected to an SR process; however, when contained in an excessive amount, the low-temperature toughness thereof is deteriorated. Therefore, either element is preferably contained in an amount of 0.50% or less. In order to demonstrate the effect by these elements, either element is preferably contained in an amount of 0.04% or more. When either element is contained in an amount of below the number, the element is handled as an inevitable impurity.

[Ca: 0.0005 to 0.0040%]

Ca is effective for improving the toughness of a steel sheet by controlling inclusions; however, when contained in an excessive amount, Ca deteriorates the toughness of the steel; hence, Ca is preferably contained in an amount of 0.0040% or less. Ca is preferably contained in an amount of 0.0005% or more in order to demonstrate such effect.

In a high-strength steel sheet of the present invention, when a chemical elements composition of the sheet, and a De value and a carbon equivalent Ceq represented by the above Equations (1) and (2), meet the specified ranges, respectively, dislocation annihilation created when being subjected to an SR process is suppressed such that a certain amount of dislocations remains, allowing strength reduction after being subjected to the SR process to be suppressed. In order to attain such effect, a dislocation density ρ of $2.5\times10^{14}$ ($/m^2=m/m^3$) or more is required to be secured after being subjected to an SR process. In order to increase the dislocation density ρ to the extent where such dislocation density ρ can be secured after being subjected to an SR process, rolling is necessary to be carried out in a non-recrystalline temperature region in which recrystallization does not occur and dislocation does not annihilate, not in a recrystalline temperature region in which dislocation annihilates due to recrystallization. Also, in order to increase a dislocation density ρ by such rolling to the extent where the dislocation density ρ can be secured after being subjected to an SR process, a reduction rate in rolling in a non-recrystalline region [total reduction rate=(difference of sheet thickness before and after rolling)/(sheet thickness before rolling)×100%] is necessary to be 10% or more.

In the TMCP process, "control of the austenite state" by rolling and "control of transformation from the controlled austenite state" that is successively carried out, are applied. In the present invention, dislocation density is used for securing strength as follows: the above TMCP process is used effectively such that dislocation is introduced on its way by rolling in a non-recrystalline temperature region, the dislocation being continued to remain after the transformation with the use of controlled cooling carried out after the rolling.

In the production process other than the process described above, that of the normal TMCP may be carried out; however, with respect to a QT steel in which reheating, quenching and tempering are carried out, the dislocation annihilates in the stage of reheating, hence such dislocation density ρ as stated above cannot be secured after being subjected to an SR process.

EXAMPLES

Hereinafter, the present invention will be described in detail with reference to the following Examples; however, the Examples are not intended to limit the present invention, and the invention can also be implemented by modifying the Examples appropriately within the range of conforming with the aforementioned and later-mentioned sprit of the invention, any one of which falls within the scope of the invention.

Steel ingots having various chemical elements compositions illustrated in Table 1, which were melted in a converter and subjected to continuous casting, were subjected to rolling including one in a non-recrystalline region ($Ar_3$ transformation point to 900° C.) on its way; and subjected to accelerated cooling at a temperature above the $Ar_3$ transformation point (cooling rate: 3 to 30° C./s) to prepare various steel sheets. The steel sheets thus obtained were subjected to an SR process at 615° C. for 23 hours (P value defined by the above Equation (3) was 18.97).

$Ar_3$ transformation point of each steel type is shown in Table 1, which is obtained based on the following Equation (4):

$$Ar_3=910-310[C]-80[Mn]-20[Cu]-15[Cr]-55[Ni]-80[Mo]+0.35(t-8) \quad (4)$$

where, [ ] represents a content of each element (mass %) and t represents sheet thickness (mm).

Using each steel sheet thus obtained, low-temperature joint toughness (HAZ toughness) and tensile strength (tensile strength TS after being subjected to an SR process) were measured in the following way. Also, with respect to each steel sheet after being subjected to an SR process, dislocation density ρ and dislocation annihilation rate k were measured in the following way.

[Low-Temperature Joint Toughness (HAZ Toughness)]

Each steel sheet after being subjected to an SR process was subjected to multilayer deposit welding by shielded metal arc welding with a welding heat input of 50 kJ/cm. A specimen in accordance with ASTM A370-05 was taken from t (t: sheet thickness)/4 portion (center of the width of a HAZ) in the direction perpendicular to the direction of the welding line, such that the HAZ toughness was evaluated. An absorbed energy ($vE_{-46}$) was measured after a Charpy impact test was carried out at −46° C. in accordance with ASTM A370-05. At the time, the absorbed energy ($vE_{-46}$) was measured with respect to three specimens of each steel sheet and an average of them was determined. A steel sheet with an average of $vE_{-46}$ of 55 J or more was evaluated as excellent in the HAZ toughness.

[Tensile Test]

With respect to each steel sheet after being subjected to an SR process, a specimen in accordance with ASTM A370-05 (0.500 to in. Round Spacimen) was taken from t (t: sheet thickness)/4 portion in the direction perpendicular to the rolling direction; and a tensile test was carried out in accordance with ASTM A370-05 such that tensile strength (TS) was measured. A steel sheet with tensile strength TS of 550 MPa or more was evaluated as good in the SR property.

[Measurement for Dislocation Density]

With respect to the t (t: sheet thickness)/4 portion of each steel sheet after being subjected to an SR process, dislocation density ρ was calculated based on the following apparatus, measurement conditions, and Equation (5):

(Apparatus)

X-ray Diffraction Apparatus: "RAD-RU300" (made by Rigaku Corporation)

(Measurement Conditions)

Target: Co (Kα)

Target Output: 40 kV-200 mA

Slit: Emission 1°, Dispersion 1°, Receiving 0.15 mm

Measurement Range (2θ): 30 to 130°

Visual Field (Measuring Area): 88 $mm^2$ $$\rho=14.4\,\epsilon^2/b^2 \quad (5)$$

TABLE 1

| Experiment | Chemical Elements Composition* (Mass: With Respect To Ca, N; Mass ppm) | | | | | | | | | | | | | | | DE Value (mass | Carbon Equivalent Ceq | |
|---|---|---|---|---|---|---|---|---|---|---|---|---|---|---|---|---|---|---|
| No. | C | Si | Mn | P | S | Cu | Al | Ni | Cr | Mo | V | Nb | Ti | Ca | N | %) | (mass %) | $Ar_3$ (° C.) |
| 1 | 0.12 | 0.36 | 1.33 | 0.009 | 0.002 | 0.01 | 0.033 | 0.00 | 0.01 | 0.00 | 0.001 | 0.009 | 0.020 | 0 | 48 | 0.0294 | 0.345 | 788 |
| 2 | 0.12 | 0.34 | 1.35 | 0.006 | 0.001 | 0.11 | 0.038 | 0.44 | 0.21 | 0.04 | 0.024 | 0.001 | 0.013 | 12 | 52 | 0.0228 | 0.436 | 754 |
| 3 | 0.12 | 0.34 | 1.36 | 0.005 | 0.001 | 0.10 | 0.035 | 0.46 | 0.22 | 0.05 | 0.024 | 0.010 | 0.014 | 15 | 53 | 0.0329 | 0.443 | 751 |
| 4 | 0.12 | 0.34 | 1.52 | 0.012 | 0.005 | 0.09 | 0.046 | 0.46 | 0.21 | 0.10 | 0.027 | 0.018 | 0.011 | 0 | 51 | 0.0387 | 0.477 | 735 |
| 5 | 0.13 | 0.35 | 1.52 | 0.007 | 0.002 | 0.03 | 0.033 | 0.01 | 0.19 | 0.00 | 0.025 | 0.018 | 0.012 | 15 | 47 | 0.0389 | 0.429 | 766 |
| 6 | 0.10 | 0.06 | 1.81 | 0.010 | 0.002 | 0.01 | 0.045 | 0.01 | 0.23 | 0.00 | 0.023 | 0.022 | 0.021 | 19 | 52 | 0.0516 | 0.454 | 750 |
| 7 | 0.12 | 0.36 | 1.53 | 0.006 | 0.002 | 0.01 | 0.040 | 0.00 | 0.21 | 0.00 | 0.022 | 0.018 | 0.013 | 24 | 46 | 0.0392 | 0.422 | 769 |
| 8 | 0.16 | 0.41 | 1.40 | 0.008 | 0.003 | 0.02 | 0.035 | 0.02 | 0.05 | 0.00 | 0.059 | 0.024 | 0.017 | 18 | 45 | 0.0591 | 0.418 | 754 |
| 9 | 0.12 | 0.40 | 1.32 | 0.007 | 0.002 | 0.46 | 0.044 | 0.48 | 0.16 | 0.00 | 0.013 | 0.025 | 0.007 | 0 | 49 | 0.0371 | 0.437 | 751 |
| 10 | 0.12 | 0.45 | 1.45 | 0.007 | 0.006 | 0.15 | 0.040 | 0.20 | 0.07 | 0.01 | 0.044 | 0.007 | 0.024 | 12 | 65 | 0.0447 | 0.410 | 763 |
| 11 | 0.12 | 0.23 | 1.41 | 0.008 | 0.003 | 0.00 | 0.036 | 0.01 | 0.19 | 0.02 | 0.006 | 0.016 | 0.018 | 24 | 54 | 0.0372 | 0.399 | 770 |
| 12 | 0.13 | 0.14 | 1.53 | 0.009 | 0.003 | 0.01 | 0.038 | 0.00 | 0.20 | 0.00 | 0.032 | 0.014 | 0.011 | 11 | 52 | 0.0361 | 0.432 | 766 |
| 13 | 0.12 | 0.26 | 1.52 | 0.006 | 0.002 | 0.02 | 0.033 | 0.02 | 0.21 | 0.01 | 0.038 | 0.023 | 0.022 | 17 | 59 | 0.0580 | 0.428 | 767 |
| 14 | 0.11 | 0.13 | 1.48 | 0.005 | 0.001 | 0.00 | 0.036 | 0.40 | 0.18 | 0.00 | 0.021 | 0.016 | 0.011 | 13 | 45 | 0.0347 | 0.424 | 755 |

Balance: Iron and Inevitable Impurities Excluding P and S where, b (constant) is $0.25\times10^{-9}$, and $\epsilon$ represents a value calculated by the Hall method.

[Measurement for Dislocation Annihilation Rate k]

A reduction rate ($d\rho/dt_1$) of the dislocation density when a material with a dislocation density $\rho$ is subjected to a heat treatment at a constant temperature for $t_1$ hours, is calculated by the following Equation (6). In the case, k is referred to as a dislocation annihilation rate; and a smaller k means that the dislocation is more difficult to be annihilated (that is, has a higher effect of suppressing dislocation annihilation). In the present invention, with respect to each steel sheet, dislocation annihilation rate k was calculated in order to compare effects of suppressing dislocation annihilation.

$$d\rho/dt_1=-k\rho^2 \quad (6)$$

These measurement results [dislocation density $\rho$, dislocation annihilation rate k, tensile strength TS after being subjected to an SR process (TS after SR), and HAZ toughness ($vE_{-46}$)] are shown in Table 2 as well as sheet thickness and total reduction rate in a non-recrystalline region of each steel sheet.

TABLE 2

| Experiment No. | Sheet Thickness (mm) | Total Reduction Rate in Non-recrystalline Region (%) | Dislocation Annihilation Rate k ($\times10^{-17}$) | Dislocation Density $\rho$ after SR Treatment ($/m^2$) | TS after SR (MPa) | HAZ Toughness ($vE_{-46}$) (J) |
|---|---|---|---|---|---|---|
| 1 | 70 | 15 | 14.21 | $1.3\times10^{14}$ | 507 | 137 |
| 2 | 70 | 11 | 13.08 | $1.9\times10^{14}$ | 523 | 101 |
| 3 | 70 | 11 | 7.07 | $2.2\times10^{14}$ | 545 | 58 |
| 4 | 70 | 12 | 5.54 | $6.3\times10^{14}$ | 654 | 48 |
| 5 | 70 | 12 | 5.94 | $5.1\times10^{14}$ | 611 | 93 |
| 6 | 65 | 14 | 5.03 | $6.6\times10^{14}$ | 653 | 76 |
| 7 | 70 | 10 | 6.02 | $2.6\times10^{14}$ | 591 | 115 |
| 8 | 30 | 53 | 4.88 | $6.8\times10^{14}$ | 658 | 114 |
| 9 | 70 | 13 | 5.82 | $4.5\times10^{14}$ | 603 | 82 |
| 10 | 70 | 12 | 5.97 | $3.8\times10^{14}$ | 593 | 134 |
| 11 | 50 | 38 | 5.40 | $6.1\times10^{14}$ | 617 | 96 |
| 12 | 70 | 11 | 5.38 | $6.3\times10^{14}$ | 627 | 64 |
| 13 | 70 | 13 | 6.10 | $3.4\times10^{14}$ | 593 | 98 |
| 14 | 70 | 11 | 5.82 | $4.9\times10^{14}$ | 604 | 112 |

From these results, discussions can be made as follows (the following No. represents Experiment No. in Table 2): Nos. 5 to 14 meet the requirements [chemical elements, ranges of the values specified by Equations (1) and (2), and dislocation densities $\rho$]; hence, not only certain tensile strength TS can be secured even after a severe SR process, but also the low-temperature toughness (HAZ toughness) is good.

On the other hand, Nos. 1 to 4 does not meet any one of requirements specified by the present invention; hence, any one of properties is deteriorated. Specifically, the DE values of Nos. 1 to 3 do not fall within the range specified by the invention; hence, the dislocation annihilation rates k are large.

The DE value of No. 4 falls within the range specified by the invention; hence, the dislocation annihilation rate k is small; however, the carbon equivalent Ceq exceeds the range specified by the invention; hence the HAZ toughness is deteriorated.

Figure 2:
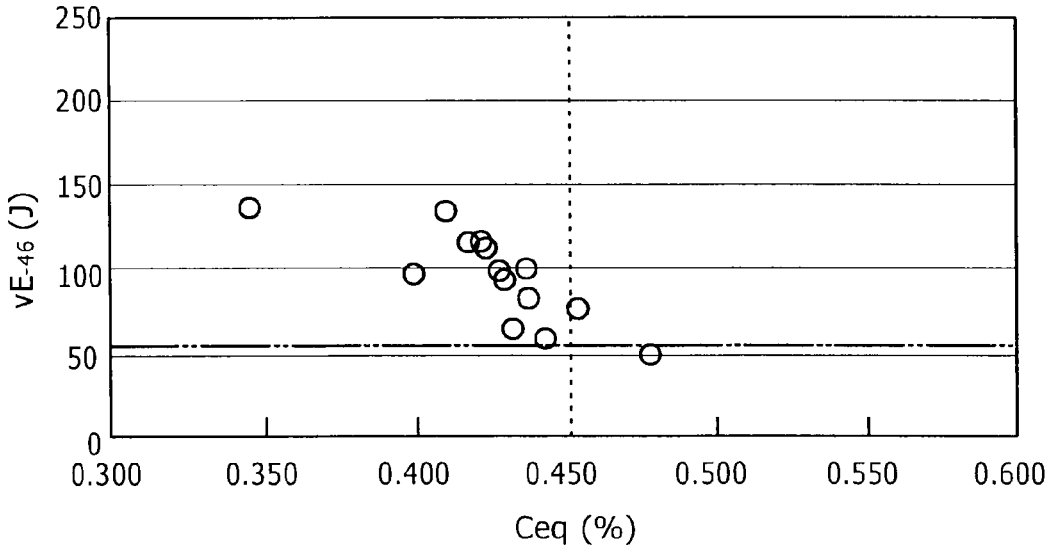
FIG. 2 is a graph showing the relation between the carbon equivalent Ceq and the HAZ toughness ($vE_{-46}$).

Based on these data, the relation between the DE value and the dislocation annihilation rate k is shown in FIG. 1, and the relation between the carbon equivalent Ceq and the HAZ toughness is shown in FIG. 2. It can be understood that it is important: to increase a DE value to 0.0340 (%) or more in order to keep the dislocation density $\rho$ high; and to lower a carbon equivalent Ceq to 0.45 (%) or less in order to secure good HAZ toughness.

What is claimed is:

1. A high-strength steel sheet, having a composition comprising:

C at 0.10 to 0.16% (herein, the term "%" means "mass %", the same is true hereinbelow), Si at 0.05 to 0.50%, Mn at 1.3 to 1.9%, Al at 0.01 to 0.05%, Ti at 0.005 to 0.025%, Nb at 0.005 to 0.025%, V at 0.005 to 0.06%, Cr at 0.05 to 0.25%, N at 0.0030 to 0.01%, and Mo at 0.00 to 0.02%, with a balance consisting of iron and inevitable impurities, wherein a DE value defined by the following Equation (1) is 0.0340% or more, where $$DE\ \text{value}=[Ti]+[Nb]+0.3[V]+0.0075[Cr] \quad (1)$$

and [Ti], [Nb], [V], and [Cr] represent contents (mass %) of Ti, Nb, V, and Cr, respectively;

wherein V and Cr are made to remain as respective carbides in the steel sheet by the combined content of Nb;

wherein a carbon equivalent Ceq defined by the following Equation (2) is 0.45% or less, where $$Ceq=[C]+[Mn]/6+([Cr]+[Mo]+[V])/5+([Cu]+[Ni])/15 \quad (2)$$

and [C], [Mn], [Cr], [Mo], [V], [Cu], and [Ni] represent contents (mass %) of C, Mn, Cr, Mo, V, Cu, and Ni, respectively;

wherein the steel sheet has a thickness in a range of from 30 to 70 mm;

wherein the steel sheet is obtained by a process comprising rolling an ingot having the composition of the steel sheet wherein the rolling is carried out at a reduction rate of 10% or more in a non-recrystalline temperature region; and wherein the steel sheet has a tensile strength in a range of from 591 to 658 MPa after the steel sheet is annealed at 615° C. for 23 hours.

2. The high-strength steel sheet according to claim 1, wherein the high-strength steel sheet further comprises Cu at 0.04 to 0.50%.

3. The high-strength steel sheet according to claim 1, wherein the high-strength steel sheet further comprises Ni at 0.04 to 0.50%.

4. The high-strength steel sheet according to claim 1, wherein the high-strength steel sheet further comprises Ca at 0.0005 to 0.0040%.

5. The high-strength steel sheet according to claim 1, wherein the high-strength steel sheet has the DE value of 0.0370% or more.

6. The high-strength steel sheet according to claim 1, wherein the high-strength steel sheet comprises C at 0.11 to 0.13%.

7. The high-strength steel sheet according to claim 1, wherein the high-strength steel sheet comprises Si at 0.20 to 0.40%.

8. The high-strength steel sheet according to claim 1, wherein the high-strength steel sheet comprises Mn at 1.40 to 1.6%.

9. The high-strength steel sheet according to claim 1, wherein the high-strength steel sheet comprises Al at 0.015 to 0.03%.

10. The high-strength steel sheet according to claim 1, wherein the high-strength steel sheet comprises Ti at 0.005 to 0.020%.

11. The high-strength steel sheet according to claim 1, wherein the high-strength steel sheet comprises Nb at 0.010 to 0.025%.

12. The high-strength steel sheet according to claim 1, wherein the high-strength steel sheet comprises V at 0.020 to 0.040%.

13. The high-strength steel sheet according to claim 1, wherein the high-strength steel sheet comprises Cr at 0.10 to 0.25%.

14. The high-strength steel sheet according to claim 1, wherein the high-strength steel sheet has a dislocation annihilation rate at 615° C. in a range of from $4.88\times10^{-17}$ to $6.10\times10^{-17}$ $m^2$/hr.

15. A method of making a high-strength steel sheet, the method comprising rolling a steel; and producing the steel sheet of claim 1.

16. A high-strength steel sheet, having a composition comprising:

C at 0.10 to 0.16% (herein, the term "%" means "mass %", the same is true hereinbelow), Si at 0.05 to 0.50%, Mn at 1.3 to 1.9%, Al at 0.01 to 0.05%, Ti at 0.005 to 0.025%, Nb at 0.005 to 0.025%, V at 0.005 to 0.06%, Cr at 0.05 to 0.25%, N at 0.0030 to 0.01%, and Mo at 0.00 to 0.02%, with a balance consisting of iron and inevitable impurities, wherein a DE value defined by the following Equation (1) is 0.0340% or more, where $$DE\ \text{value}=[\text{Ti}]+[\text{Nb}]+0.3[\text{V}]+0.0075[\text{Cr}] \quad (1)$$

and [Ti], [Nb], [V], and [Cr] represent contents (mass %) of Ti, Nb, V, and Cr, respectively;

wherein the Ti, Nb, V, and Cr form stable precipitations of TiC, NbC, VC and $Cr_2C$ in the composition;

wherein a carbon equivalent Ceq defined by the following Equation (2) is 0.45% or less, where $$Ceq=[\text{C}]+[\text{Mn}]/6+([\text{Cr}]+[\text{Mo}]+[\text{V}])/5+([\text{Cu}]+[\text{Ni}])/15 \quad (2)$$

and [C], [Mn], [Cr], [Mo], [V], [Cu], and [Ni] represent contents (mass %) of C, Mn, Cr, Mo, V, Cu, and Ni, respectively;

wherein the steel sheet has a thickness in a range of from 30 to 70 mm;

wherein the steel sheet is obtained by a process comprising rolling an ingot having the composition of the steel sheet wherein the rolling is carried out at a reduction rate of 10% or more in a non-recrystalline temperature region; and wherein the steel sheet has a tensile strength in a range of from 591 to 658 MPa after the steel sheet is annealed at 615° C. for 23 hours.

* * * * *